US009227217B2

(12) United States Patent
Lee

(10) Patent No.: US 9,227,217 B2
(45) Date of Patent: Jan. 5, 2016

(54) NOZZLE CLEANING BLADE OF JET VALVE FOR DISPENSING

(76) Inventor: Gu-Hwan Lee, Yeonsu-gu (KR)

( * ) Notice: Subject to any disclaimer, the term of this patent is extended or adjusted under 35 U.S.C. 154(b) by 0 days.

(21) Appl. No.: 13/983,501

(22) PCT Filed: Feb. 8, 2012

(86) PCT No.: PCT/KR2012/000911

§ 371 (c)(1),
(2), (4) Date: Sep. 27, 2013

(87) PCT Pub. No.: WO2012/108681

PCT Pub. Date: Aug. 16, 2012

(65) Prior Publication Data

US 2014/0026345 A1 Jan. 30, 2014

(30) Foreign Application Priority Data

Feb. 8, 2011 (KR) ..... 10-2011-0010925

(51) Int. Cl.

| | |
|---|---|
| ***B05B 1/08*** | (2006.01) |
| ***B05B 15/02*** | (2006.01) |
| ***B41J 2/165*** | (2006.01) |
| ***B08B 1/00*** | (2006.01) |

(52) U.S. Cl.

CPC ..... *B05B 15/0208* (2013.01); *B08B 1/006* (2013.01); *B08B 1/008* (2013.01); *B41J 2/16585* (2013.01)

(58) Field of Classification Search

CPC ..... B05B 15/0208; B05B 1/08; B05B 1/06; B05B 15/02; B05B 15/0241; B41J 2/16585; B41J 2/16547; B41J 2/16526; B41J 2/16538; B41J 2/16535

USPC ..... 239/114, 106, 123; 347/22, 33

See application file for complete search history.

(56) References Cited

U.S. PATENT DOCUMENTS

| | | | | | |
|---|---|---|---|---|---|
| 3,604,466 | A | * | 9/1971 | Strauss et al. | 139/1 R |
| 5,396,271 | A | * | 3/1995 | Premnath | 347/33 |
| 5,416,456 | A | * | 5/1995 | Light | 335/205 |
| 5,432,539 | A | * | 7/1995 | Anderson | 347/33 |
| 5,493,319 | A | * | 2/1996 | Hirabayashi et al. | 347/29 |
| 5,548,310 | A | * | 8/1996 | Binnert et al. | 347/33 |
| 5,555,461 | A | * | 9/1996 | Ackerman | 347/33 |
| 5,847,727 | A | * | 12/1998 | VanLiew et al. | 347/33 |
| 5,949,448 | A | * | 9/1999 | Man et al. | 347/33 |

FOREIGN PATENT DOCUMENTS

| | | |
|---|---|---|
| JP | 08-02112 A | 1/1996 |
| JP | 2007 253361 A | 10/2007 |

OTHER PUBLICATIONS

Written Opinion of PCT/KR2012/000911 Mailed Sep. 17, 2012.

* cited by examiner

*Primary Examiner* — Justin Jonaitis
(74) *Attorney, Agent, or Firm* — Robert W. J. Usher

(57) ABSTRACT

The present invention relates to a nozzle cleaning blade of a dispensing jet valve. The nozzle cleaning blade includes a plurality of blades (20) vertically formed at right and left of the top surface of a fixing plate (21) on a working tray (T), which moves laterally along guide rails in a state where a target product is seated on the working tray (T), so as to clean a nozzle (12) of a jet valve (10) which is mounted movably in vertical and horizontal directions and injects a coating liquid in order to join or process a specific portion of the target product. The fixing plate (21) is fixed to a bracket (30) which is detachably mounted on the top surface of the working tray (T), and the blades (20) are inclinedly formed on the fixing plate (21) in a lateral direction.

5 Claims, 4 Drawing Sheets

NOZZLE CLEANING BLADE OF JET VALVE FOR DISPENSING

TECHNICAL FIELD

The present invention relates to a nozzle cleaning blade of a dispensing jet valve for dispensing, and more particularly, to a nozzle cleaning blade of a dispensing jet valve, which is mounted on a dispensing device and effectively wipe off fluid particles stained and remaining on a nozzle of the jet valve which moves to a target product and injects a coating liquid to join or process a specific portion of the target product, thereby reducing the period of time to wash off the coating liquid as compared with the existing roll brushes.

BACKGROUND ART

In general, a dispensing device is used for converting a large amount of liquid, which is used in fine chemicals industry, into minute particles and precisely coating a specific portion of a target product, for instance, in order to join the target product or process the surface of the target product with a specific coating liquid. Such a coating liquid is injected through a dispensing gun, namely, through a nozzle of a jet valve disposed on the dispensing gun, so as to precisely join or process materials, for instance, in the semiconductor manufacturing process.

In order to enhance the degree of precision, an outlet of the nozzle to inject the coating liquid is formed finely, and hence, it is very important to control injection pressure, time, speed, range, amount, and others of the coating liquid injected through the nozzle instantly.

The jet valve is conveyed together with a robot arm in a position selectable manner from a conveying device or is controlled by a program set to be moved in horizontal and vertical directions according to the position movement of a transfer in order to inject and coat the coating liquid to the specific portion so as to process the target product. In a state where coating work from the nozzle is finished, the coating liquid remaining on the nozzle is cleaned and washed off by the air blowing method.

However, because the coating liquid is minutely accumulated on an end portion of the nozzle from which the coating liquid is injected, it influences on the dispensing accuracy of the coating liquid. Moreover, such a problem gradually has an influence on the next injection of the coating liquid, and hence, causes a faulty process of the target product.

Furthermore, there is an inconvenience to reset air consumption according to ingredients of the coating liquid, and it causes difficulty in performance recovery of the jet valve because of accumulation of foreign matters on the nozzle due to a change in pressure.

In order to overcome the above problem, the inventor of the present invention has Korean Patent No. 10-996557 entitled "nozzle cleaning apparatus of a dispensing jet valve".

In Korean Patent No. 10-996557, as shown in FIG. 1, the nozzle cleaning apparatus 100 of the dispensing jet valve includes: a roll brush (120) for cleaning a nozzle 2 of the lower part of a jet valve 1 which is moved from a dispensing device and disposed for injecting a coating liquid to join and process a specific portion of a target product; and driving means 130 for rotating the roll brush 120 in forward and backward directions. The nozzle cleaning device 100 further includes: a mounting block 110 having a first space part 111 opened at the top portion, a second space part 112 disposed at the rear of the first space part 111 and opened at the top portion and both sides, and a connection part 113 disposed at the lower part of the front and having a joining hole 113*a* to which a fastening member (S) is fixed from the dispensing device, the roll brush 120 being mounted inside the first space part 111 of the mounting block 110, the driving means 130 being mounted in the second space part 112 of the mounting block 110 and connected to the roll brush 120 via a rotational connection shaft 131 penetrating the first space part 111 from the second space part 111, such that the driving means 130 rotatably drives the rotational connection shaft 131 by air pressure so as to rotate the roll brush 120 in forward and backward directions; a driving pressure controller 150 connected with air supply lines (P) to control a driving pressure by air supply; a main controller 160 electrically connected with the driving pressure controller 150 so as to control a driving time setting and a power supply of the driving pressure controller 150; and a pollution preventing cover 140 disposed on the top of the first space part 111 and having an open middle portion, which is smaller than an area of the opened top portion of the first space part 111, and, to which the bottom portion of the jet valve 1 is guided, such that foreign matters are not scattered to the outside when the nozzle 2 of the jet valve 1 is cleaned.

That is, the nozzle 2 cleans the coating liquid stained on the nozzle using the rotational roll brush 120. However, because the residue of the coating liquid scattered through the roll brush is, in fact, minutely stained on the nozzle again, the roll brush needs a sufficient rotation period of time. Accordingly, the nozzle cleaning device of the dispensing jet valve has a disadvantage in that it takes a long period of time to clean and wash off the coating liquid through the dispensing device.

DISCLOSURE

Technical Problem

Accordingly, the present invention has been made in an effort to solve the above-mentioned problems occurring in the prior arts, and it is an object of the present invention to provide a nozzle cleaning blade of a dispensing jet valve, which is mounted on a dispensing device and effectively wipe off fluid particles stained and remaining on a nozzle of the jet valve which moves to a target product and injects a coating liquid to join or process a specific portion of the target product, thereby reducing the period of time to wash off the coating liquid as compared with the existing roll brushes.

Technical Solution

To achieve the above objects, the present invention provides a nozzle cleaning blade of a dispensing jet valve, which includes a plurality of blades vertically formed at right and left of the top surface of a fixing plate on a working tray, which moves laterally along guide rails in a state where a target product is seated on the working tray, so as to clean a nozzle of a jet valve which is mounted movably in vertical and horizontal directions and injects a coating liquid in order to join or process a specific portion of the target product, wherein the fixing plate is fixed to a bracket which is detachably mounted on the top surface of the working tray, and the blades are inclinedly formed on the fixing plate in a lateral direction.

Advantageous Effects

The nozzle cleaning blade of the dispensing jet valve according to the present invention elastically comes in contact with the nozzle of the jet valve, which injects the coating liquid for joining or processing the target product with high precision, such that the blade cleans and wipes off the residue of the coating liquid. Therefore, the nozzle cleaning blade prevents the residue of the minute coating liquid from being stained on the surface of the nozzle as compared with the existing rotational type roll brushes, such that the continuous injection of the coating liquid through the nozzle of the jet valve is carried out uniformly at wanted pressure, thereby realizing precise processing of high precision materials.

MODE FOR INVENTION

Figure 1:
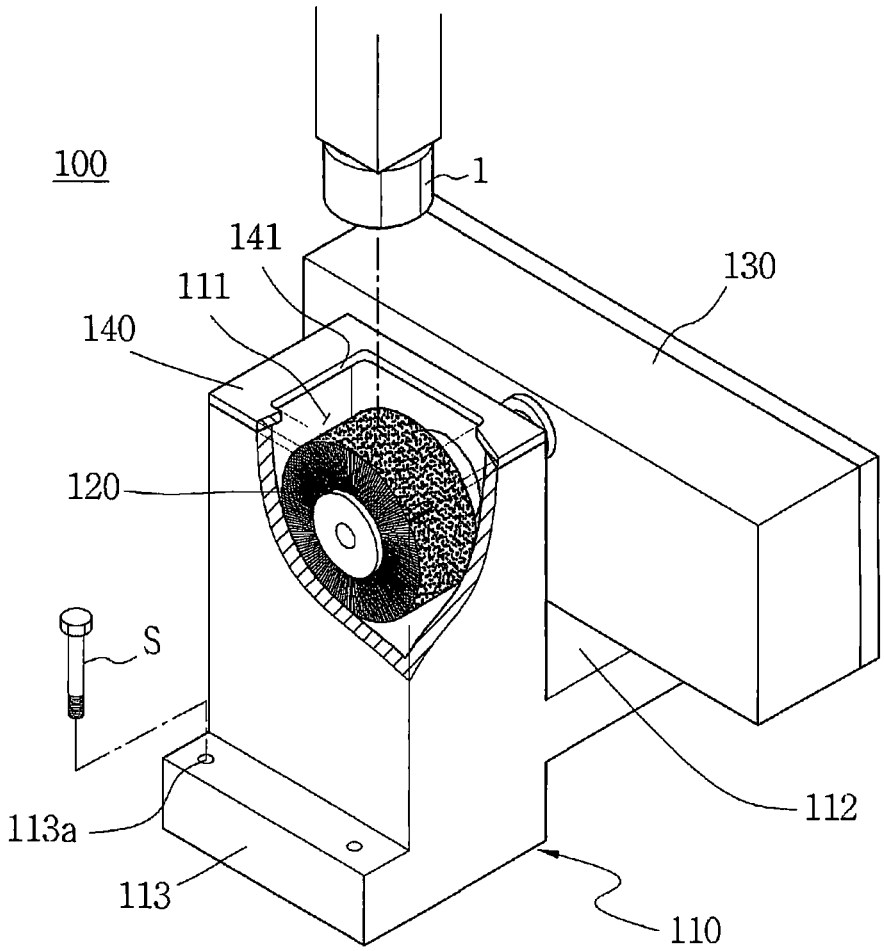
FIG. 1 is a perspective view of a nozzle cleaning device of a dispensing jet valve according to a prior art.
Figure 2:
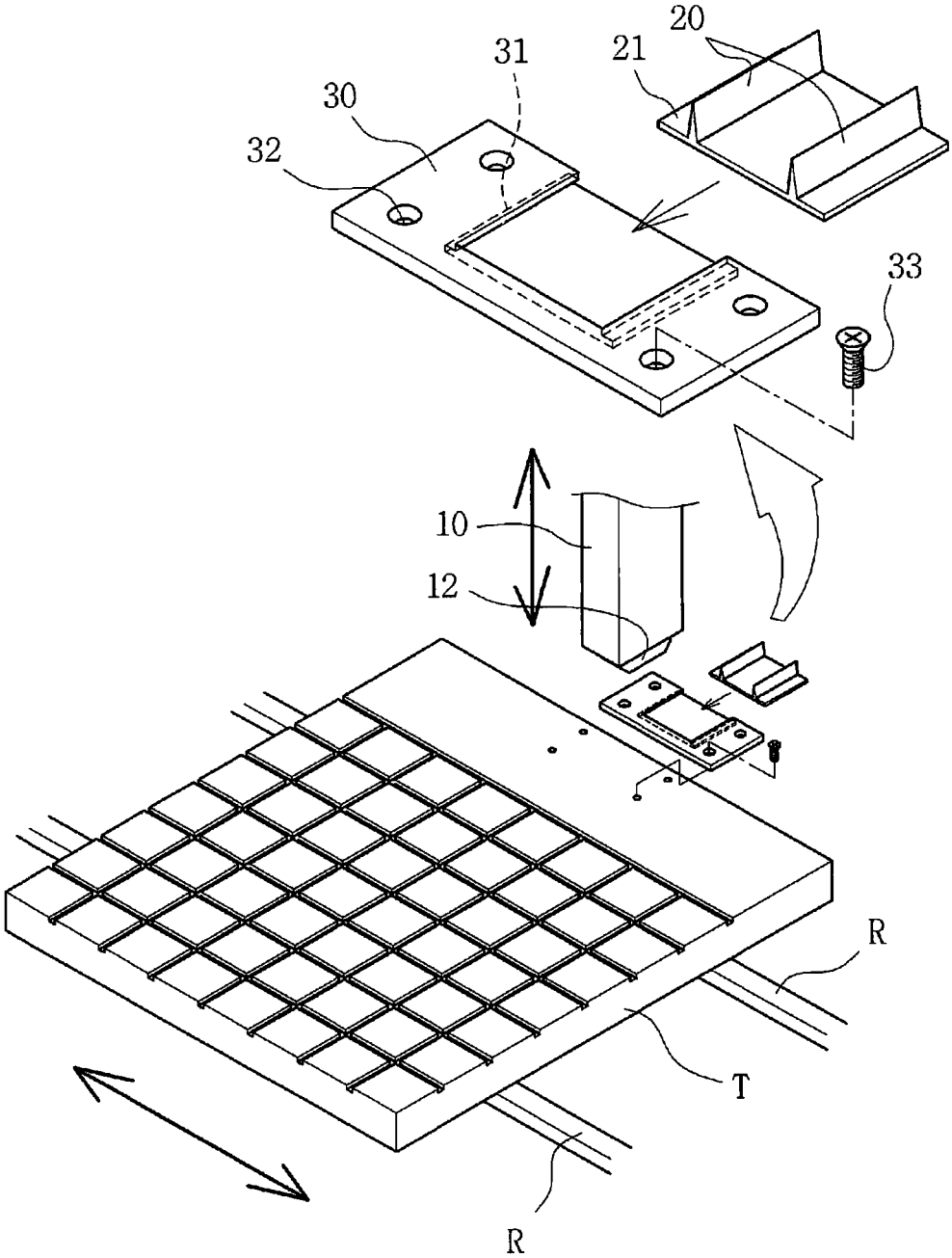
FIG. 2 is a perspective view showing a jet valve and a working tray having blades according to the present invention.

Referring to FIGS. 2 to 5, the present invention will be now described in detail as follows.

A nozzle cleaning blade of a dispensing jet valve according to the present invention includes a plurality of blades 20 vertically formed at right and left of the top surface of a fixing plate 21 on a working tray (T), which moves laterally along guide rails in a state where a target product is seated on the working tray (T), so as to clean a nozzle 12 of a jet valve 10 which is mounted movably in vertical and horizontal directions and injects a coating liquid in order to join or process a specific portion of the target product, wherein the fixing plate 21 is fixed to a bracket 30 which is detachably mounted on the top surface of the working tray (T), and the blades 20 are inclinedly formed on the fixing plate 21 in a lateral direction.

The blades 20 are the typical blades for wiping the window of a vehicle. Each of the blades 20 is sharp at the end which gets in contact with the nozzle, and is gradually widened. The blades 20 together with the fixing plate 21 are molded of a urethane rubber-based material, which is flexible and has high wear resistance.

The bracket 30 for fixing the fixing plate 21 includes: joining holes 32 formed at both sides for fastening and fixing fastening screws 33 to coupling holes disposed in the top surface of the working tray (T); and joining grooves 31 formed in the middle thereof for guiding both sides of the fixing plate 21, such that the blades 20 are conveniently replaced because they are slidably pushed in and pulled out.

The nozzle cleaning blade according to the present invent ion cleans the nozzle 12 of the jet valve 10 after the jet valve 10 injects the coating liquid through the nozzle 12 for the joining process of the precision processing material through the dispensing device (not shown in the drawings), and then, the jet valve 10 having the nozzle 12 cleaned moves toward the working tray (T) according to the set program of the dispensing device in order to carry out joining work or processing work of another precision processing material.

Figure 3:
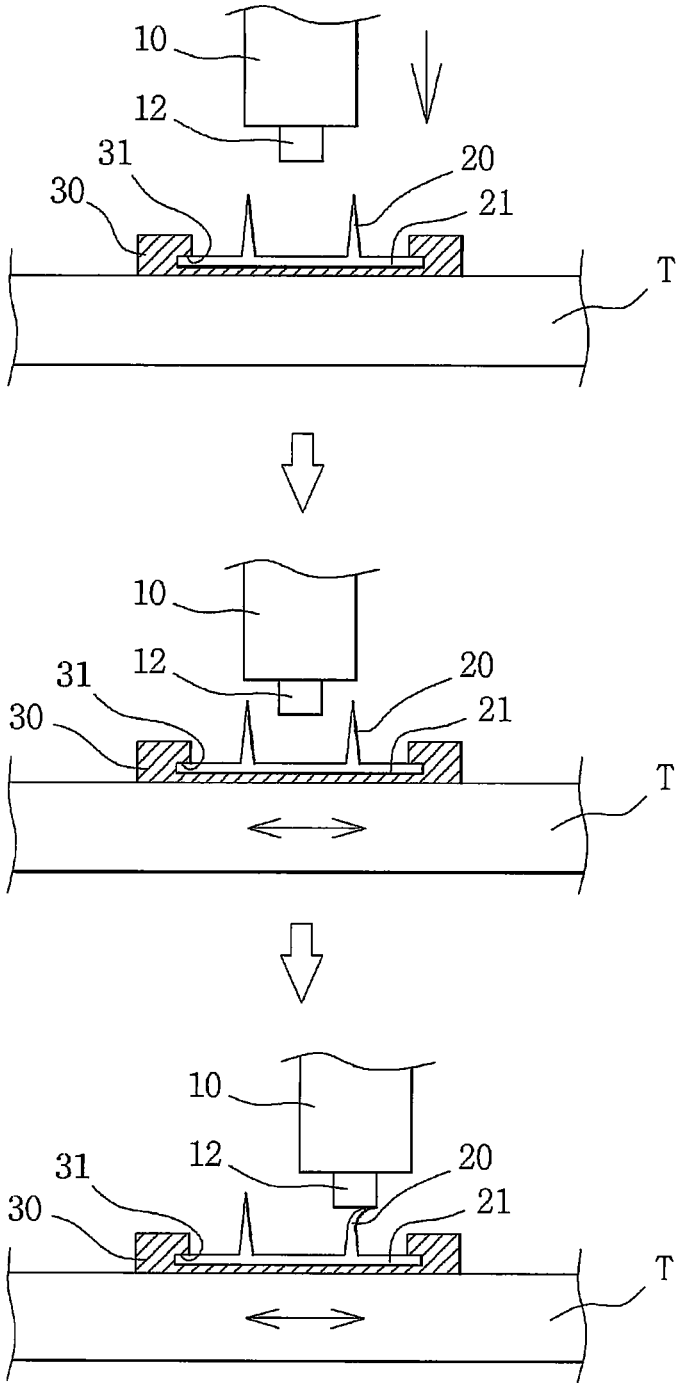
FIG. 3 is a front view showing states where a nozzle of the jet valve of FIG. 2 is cleaned in order.

A plurality of the blades 20 mounted on the bracket 30 of the working tray (T) are disposed at right and left sides on the fixing plate 21, and cleans the nozzle by wiping off the residue of the coating liquid remaining on the surface of the nozzle as shown in FIG. 3 while moving laterally when the jet valve 10 having the nozzle 12 is moved above the working tray (T) and located between the blades after finishing the injection work of the coating liquid through the nozzle 12.

Figure 4:
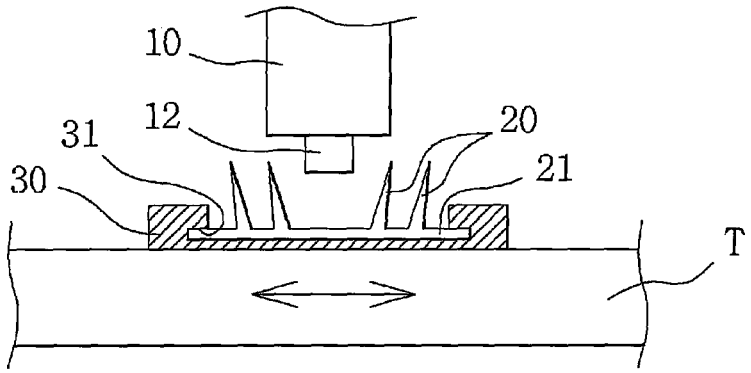
FIG. 4 is a front view showing blades according to a first preferred embodiment of the present invention.

In the meantime, as shown in FIG. 4, the blades 20 are laterally inclined on the fixing plate 21 in order to wipe clean the surface of the nozzle with a higher contact force in the reverse direction when the surface of the nozzle comes in contact with the plural blades.

As described above, the jet valve having the nozzle cleaned can accurately inject the previously set amount of the coating liquid to a correct point while moving in the vertical and horizontal directions.

Figure 5:
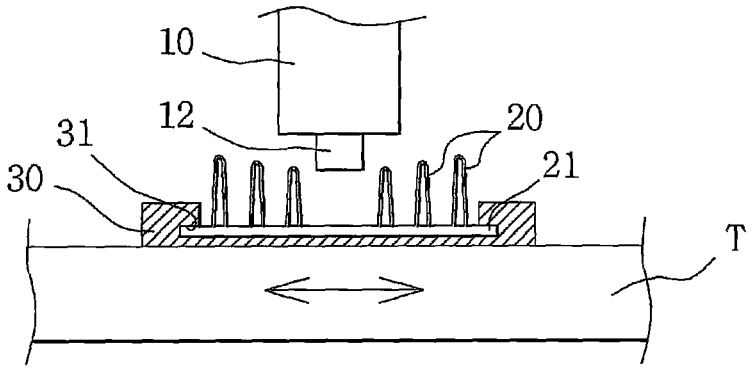
FIG. 5 is a front view showing blades according to a second preferred embodiment of the present invention.

FIG. 5 illustrates blades according to a second preferred embodiment of the present invention. In FIG. 5, the blades 20 are formed on the fixing plate 21 with different heights so as to wipe off the residue of the coating liquid remaining on the surface of the nozzle 12 by stages, so that the blades can keep the clean surface of the nozzle.

As described above, because the blades according to the present invention cleans the surface of the nozzle while the nozzle moves laterally in the state where it gets in contact with at least one blade 20, the blades can prevent stopping of the nozzle 12 which minutely injects the coating liquid for joining or processing the target product with high precision, as compared with the conventional air blowing method, and can remove the residue of the coating liquid cleaner than the conventional rotational type roll brush. Therefore, the nozzle cleaning blade of the dispensing jet valve according to the present invention can uniformly inject the coating liquid at a required pressure from the jet valve through the nozzle 12, which is continuously used, thereby realizing precise processing of high precision materials.

| <Explanation of essential reference numerals in drawings> | |
|---|---|
| 10: jet valve | 12: nozzle |
| 20: blade | 21: fixing plate |
| 30: bracket | 31: joining hole |
| 32: coupling hole | 33: fastening screw |
| T: working tray | R: guide rail |

The invention claimed is:

1. A nozzle cleaning blade assembly of a dispensing jet valve, which is mounted to clean a nozzle (12) of a jet valve (10) mounted movably in vertical and horizontal directions and which injects a coating liquid in order to join or process a specific portion of a target product, the nozzle cleaning blade assembly comprising:

a nozzle cleaning blade unit consisting essentially of a one piece molding of elastomeric material in which a plurality of resiliently flexible nozzle wiping blades (20) upstand at right angles from an upper, major face of a fixing plate (21) mounted on a working tray (T) which moves laterally along guide rails (8 in a nozzle wiping direction when the target product is seated on the working tray (T) so as to wipe the surface of the nozzle (12), the blades (20) extending in mutually parallel, face-to-face, relation across a nozzle wiping path and being located on the right and left of the fixing plate, respectively, providing between them a free, non-wiping, nozzle receiving space formed at right angles from a fixing plate (21) in such a way as to correspond mutually;

the fixing plate (21) being fixed, detachably, to a bracket (30) which is detachably mounted on the top surface of the working tray (T); and the blades (20) being inclined in the lateral, nozzle wiping direction away from the nozzle receiving space.

2. The nozzle cleaning blade according to claim 1, wherein the blades (20) are respectively formed on the fixing plate (21) at different heights.

3. The nozzle cleaning blade according to claim 1 wherein the bracket (30) has plate mounting grooves slidably receiving the fixing plate enabling the fixing plate to be mounted and demounted therefrom by a sliding action.

4. The nozzle cleaning blade according to claim 1 wherein the bracket (30) has plate mounting grooves slidably receiving the fixing plate enabling the fixing plate to be mounted and demounted therefrom by a sliding action.

5. The nozzle cleaning blade according to claim 2 wherein the bracket (30) has plate mounting grooves slidably receiving the fixing plate enabling the fixing plate to be mounted and demounted thereform by a sliding action.

* * * * *